United States Patent [19]

Takahashi et al.

[11] 4,193,264

[45] Mar. 18, 1980

[54] PRESSURED FLUID SUPPLY SYSTEM

[75] Inventors: Koichi Takahashi; Yoshikazu Hayakawa; Keizaburo Usui, all of Yokohama, Japan

[73] Assignee: Nissan Motor Company, Limited, Japan

[21] Appl. No.: 816,253

[22] Filed: Jul. 15, 1977

[30] Foreign Application Priority Data

Jul. 27, 1976 [JP] Japan ..... 51/89297

[51] Int. Cl.[2] ..... F15B 1/02

[52] U.S. Cl. ..... 60/397; 60/411; 60/413; 60/418; 417/401

[58] Field of Search ..... 60/397, 411, 477, 369, 60/371, 412, 413, 415, 418, DIG. 2, 423; 91/47; 417/401

[56] References Cited

U.S. PATENT DOCUMENTS

| | | | |
|---|---|---|---|
| 1,694,279 | 12/1928 | Oishei | 60/397 X |
| 2,463,005 | 3/1949 | Ulrich | 91/266 |
| 2,622,399 | 12/1952 | Babitch | 60/397 X |
| 2,988,890 | 6/1961 | Oishei et al. | 60/413 X |
| 3,134,304 | 5/1964 | Hager | 91/341 |
| 3,218,978 | 11/1965 | Kalert | 417/395 |
| 3,482,766 | 12/1969 | Rehfeld | 417/401 |
| 3,700,359 | 10/1972 | Vanderjagt | 417/404 |
| 3,892,283 | 7/1975 | Johnson | 60/413 X |

FOREIGN PATENT DOCUMENTS

| | | | |
|---|---|---|---|
| 2155907 | 11/1971 | Fed. Rep. of Germany | 417/401 |
| 2024119 | 8/1970 | France | 417/401 |
| 1192467 | 5/1970 | United Kingdom | 417/401 |

*Primary Examiner*—Edgar W. Geoghegan

*Attorney, Agent, or Firm*—Robert E. Burns; Emmanuel J. Lobato; Bruce L. Adams

[57] ABSTRACT

A vacuum motor operatively connected to a slave cylinder operates same via pressure differential variations across a reciprocatable vacuum motor piston to pump working fluid from a reservoir to an accumulator through two one way valves. The pressure differential variation can be derived from gear changing of the vehicle, induced through a three way electromagnetic valve controlled by a circuit characterized by either an unstable multivibrator, a dual stable multivibrator, a thyristor or a self maintaining relay, or induced through a purely mechanically operated valve characterized by lost motion and snap action position maintain devices. A pressure relief valve may be provided which dumps excessive pressurized fluid in the accumulator and returns same to the reservoir.

43 Claims, 8 Drawing Figures

PRESSURED FLUID SUPPLY SYSTEM

BACKGROUND OF THE INVENTION

1. Field of the Invention

This invention relates to a system for supplying fluid under pressure and more particularly to a pressurised fluid supply system for a motor vehicle or the like which is provided with an internal combustion engine.

2. Description of the Prior Art

As is well know, there are three basic methods of supplying pressurised fluid in a motor vehicle. One is by connecting a pump to the crank shaft of the engine and using the power directly developed by the engine to drive the pump. Another is using the vacuum developed in the induction manifold to drive a vacuum motor which is in turn connected to a pump of some description, and the third is a pump driven by an electric motor which derives its power from the battery and/or the generator or alternator driven by the engine. The first is efficient in operation but is undesirable from the point of using valuable horsepower which would otherwise be transmitted to the driving wheels of the vehicle. This, when coupled with the already numerous devices which are driven directly by the engine, such as the generator or alternator, water pump, air conditioner (if fitted), oil pump (for engine lubrication) etc. lowers the effective output of the engine undesirably. The electrically driven pump being driven by or supplied with electrical power derived from an apparatus which like the mechanically driven pump, is driven by the crank shaft (i.e. generator or alternator) suffers from the aforementioned drawback of reducing the effective output of the engine (i.e. the power reaching the driving wheels of the vehicle). Another drawback suffered by this arrangement is that at night when a great percentage of the electrical equipment of the vehicle is employed (especially on rainy days) the total demand on the electrical system could prove too much causing the battery to be drained.

SUMMARY OF THE INVENTION

Thus this invention is directed to providing a pressurised fluid supply system which overcomes the above mentioned drawbacks by using in place of the power developed by the engine the above mentioned vacuum prevailing in the induction manifold.

In detail, a piston of a vacuum motor is driven via a variable pressure differential developed thereacross to in turn drive a piston of a slave cylinder which is attached to the vacuum motor whereby fluid is pumped from a reservoir through two one way valves via the slave cylinder to an accumulator. The pressure differential variation can be derived from gear changing and/or braking of the vehicle; induced by a three way electromagnetic valve controlled by a circuit characterized by either an unstable multivibrator, a dual stable multivibrator, a thyristor or a self maintaining relay; or induced by a purely mechanically operated valve which is characterized by a lost motion device and a snap action position maintaining device both of which are connected through a two position valve. If desired a relief valve for dumping excess presssurised fluid can be provided to return said excess fluid to the reservoir for recirculation. If further desired a switch which is responsive to the pressure in the accumulator can also be incorporated with the embodiments equipped with the three way electromagnetic valve to prevent the operation of same upon sufficient pressurised fluid being stored in the accumulator.

Throughout all the embodiments it is preferred that from 4 to 8 strokes of the slave cylinder piston is sufficient to fill the accumulator which has a capacity of approximately 100 cc with fluid under 10 to 25 Kg/sw. cm.; and the accumulator is connected to an apparatus which can be effectively operated with approximately 50 cc of said fluid.

Thus it is an object of this invention to provide a pressurised fluid supply system which is operated using the vacuum prevailing in the induction manifold as a source of motive power.

It is also an object of this invention to provide a pressurised fluid supply system which is compact, simple in construction and which is arranged to fill an accumulator thereof with optimally pressurised fluid via a few strokes of the slave cylinder piston.

It is also an object of this invention to provide a pressurised fluid supply system in which the vacuum motor thereof is operated by the vacuum variations within the induction manifold, said vacuum variations being produced by changing gears, braking and the like.

It is a further object of this invention to provide a pressurised fluid supply system which has a control device interposed between the induction manifold and the vacuum motor of the system for controlling the communication therebetween.

It is yet another object of this invention to provide a pressurised fluid supply system which has an electronically controlled three way electromagnetic valve interposed between the induction manifold and the vacuum motor.

It is an object of this invention to provide a pressurised fluid supply system in which said three way electromagnetic valve is controlled by a circuit characterized by one of: an unstable multivibrator, a dual stable multivibrator, a thristor or a self maintaining relay.

It is a further object of this invention to provide a pressurised fluid supply system which has a purely mechanical control valve interposed between the induction manifold and the vacuum motor of the system which is controlled by the working strokes of the vacuum motor piston.

BRIEF DESCRIPTION OF THE DRAWINGS

Other features objects and advantages of the present invention will become more clearly understood as the description proceeds taken in conjunction with the appended drawings in which.

DESCRIPTION OF THE PREFERRED EMBODIMENTS

Figure 1:
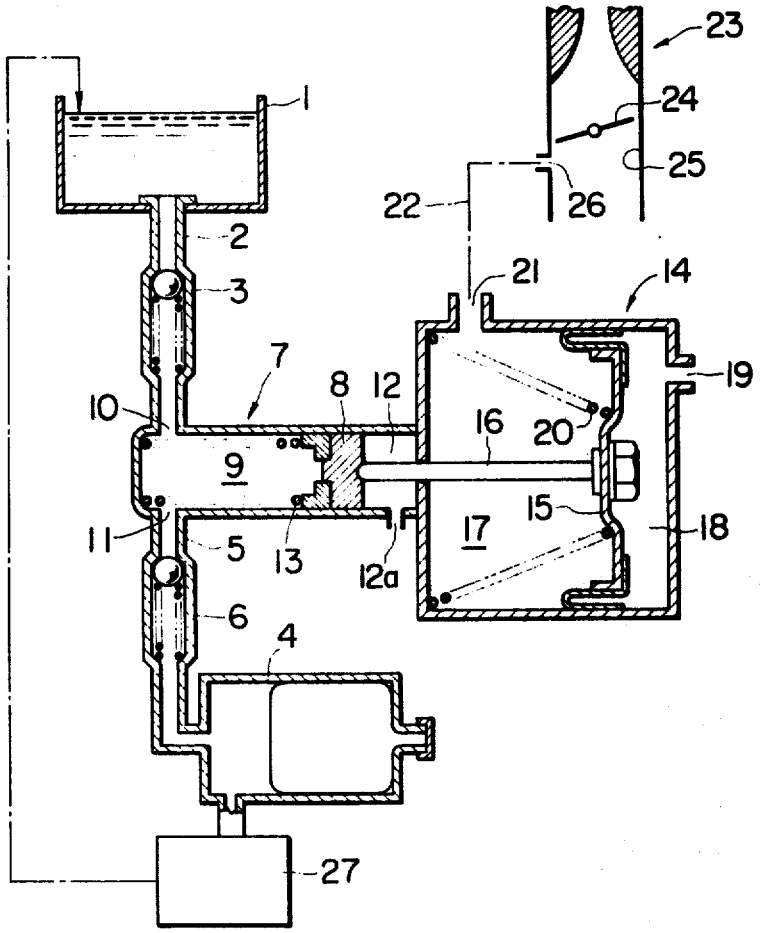
FIG. 1 shows schematically a first preferred embodiment of a pressurised fluid supply system according to the present invention.

Let us look at FIG. 1 wherein the first preferred embodiment of the pressurised fluid supply system of the invention is shown. In this figure the numeral 1 denotes a working fluid reservoir, 2 a conduit which has a one way valve 3 disposed therein which permits the fluid in the reservoir to flow from same therethrough in one direction only. The numeral 4 denotes a pressurised fluid accumulator which communicates through a one way valve 6 disposed in a conduit 5 with a slave cylinder generally denoted by 7. It will be noted that the conduit 2 is connected to the inlet 10 of the slave cylinder 7 and the conduit 5 connected to the outlet 11 thereof. The one way valve 6 is of course arranged to permit the flow of fluid from the slave cylinder to the accumulator 4 only.

Defined within a bore (no numeral) formed in the slave cylinder by a piston 8 slidably disposed therein are two variable volume chambers 9 and 12. The first chamber 9 is arranged to fluidly communicate with the two conduits 2 and 5 while the second is arranged to communicate with the atmosphere via an opening or port 12*a*. Fixedly attached to one end of the slave cylinder 7 is a power cylinder or vacuum motor 14 as it will be referred to hereafter. A piston 15 is reciprocatingly disposed within the vacuum motor 14 and has a rolling sleeve seal sealingly disposed between the outer periphery thereof and the inner wall of the casing of the vacuum motor 14 so as to divide the vacuum motor into two variable volume chambers 17 and 18. The first of them is arranged to communicate directly with the induction manifold 25 at a location downstream of the throttle valve 24 and venturi portion 23 via ports 21 and 26 through a conduit 22. The second is arranged to communicate with the atmosphere through an opening or port 19 formed in the casing of the vacuum motor. A push rod 16 is fixedly connected at one end to the piston 15 of the vacuum motor and arranged to sealingly and slidably pass through a through hole formed in the vacuum motor casing to abut the piston 8. A spring 13 disposed in the slave cylinder bore is arranged to urge the piston 8 toward the vacuum motor while a spring or return spring 20 as it will be referred to hereafter disposed in the vacuum chamber 17 of the vacuum motor 14 urges the piston 15 away from the slave cylinder 7.

A device 27 or apparatus which uses pressurised fluid as a source of motive power is fluidly connected to the accumulator 4 to receive pressurised fluid therefrom. As shown conduiting indicated by a broken line is provided to return the spent working fluid from the device 27 to the reservoir 1 for recirculation.

In operation when a vacuum of a sufficiently large magnitude is supplied to the vacuum chamber of the vacuum motor from the induction manifold through fluidly interconnected ports 26 and 21, the resulting pressure differential across the piston 15 urges it to move against the biasing force of the spring 20 so that the push rod abuts the piston 8 whereupon said differential urges both pistons 15 and 8 against the combined biasing forced of the two springs 20 and 13. At this time, the fluid in the chamber 9 is displaced therefrom through the one way valve 6 and conduit 5 into the accumulator 4.

Subsequently when the magnitude of the vacuum drops (the mechanism of the vacuum variation will be clearly explained later in the disclosure with reference to FIG. 2), the pressure differential across the piston 15 drops and the pistons 15 and 8 are returned to their home positions (as they will be referred to hereinafter) i.e. the positions taken by same when the pressure differential across the piston 15 is approximately zero. During this return stroke of the piston 8 fluid is inducted through the conduit 2 and the one way valve 3 from the reservoir 1 into the now enlarging chamber 9.

With the repetitious rising and falling of the magnitude of the vacuum within the induction manifold above and below a level which is sufficient to move the piston 15 pumping of the fluid from the reservoir into the accumulator takes place.

Figure 2:
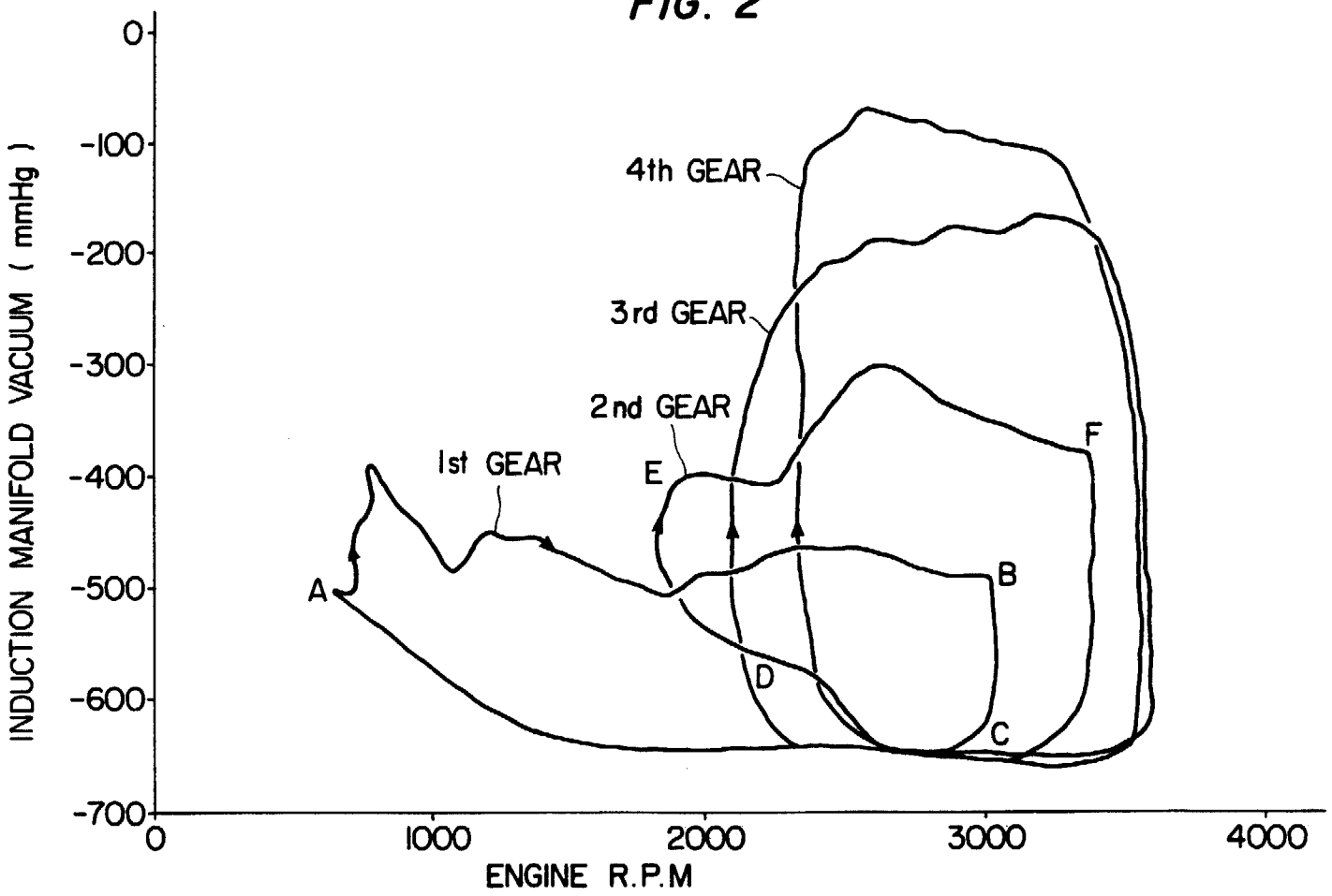
FIG. 2 is a graph of the relationship between the vacuum existing in the induction manifold (in mmHg) of the engine to which the present invention is operatively connected and the engine speed of same (in RPM) which shows the variation of the vacuum which is fed to the vacuum motor of the pressurised fluid supply system with respect to changing of gears.

Now let us turn to FIG. 2 wherein the variation of the magnitude of the vacuum with respect to the changing of gears and the associated operations is shown. It will be understood that the following is merely by way of example and the values quoted below are merely examples.

In the graph the point A represents a state of idling of the engine of the vehicle. As shown the vacuum in the induction manifold downstream of the throttle valve is approximately −500 mmHg at an engine speed of 650 RPM. Now as soon as the accelerator pedal is depressed to open the throttle valve, the vacuum in the induction manifold immediately drops to about −400 mmHg with only a slight increase in engine RPM. It is assumed that the vehicle is provided with a manual gear box and clutch and the vehicle will be started from standstill by closing the clutch and the vehicle driven in first gear between points A and B. As shown, the vacuum builds once again to about −500 mmHg and at point B the driver releases the accelerator and opens the clutch. The vacuum immediately rises as shown to approximately −620 mmHg due to the closure of the throttle valve at an engine speed of approximately 3000 RPM. During this period the vehicle is permitted to free wheel or coast due to its own momentum. Now between points C and D the driver shifts gears from first to second and between points D and E engages the clutch. Subsequent to closing of the clutch, gradual acceleration takes place between points E and F. It will be noted that as the gears are moved toward top gear the variation of the vacuum within the induction manifold increases dramatically and varies between approximately −50 mmHg and 650 mmHg. Hence it will be understood by one skilled in the art that a vacuum motor fluidly connected to an induction manifold wherein such vacuum variation takes place will be subjected to pressure differential variation sufficient to induce reciprocatory operation thereof (assuming the afore described construction) by appropriately selecting the springs 13 and 20 and the diameter of the piston 15.

Figure 3:
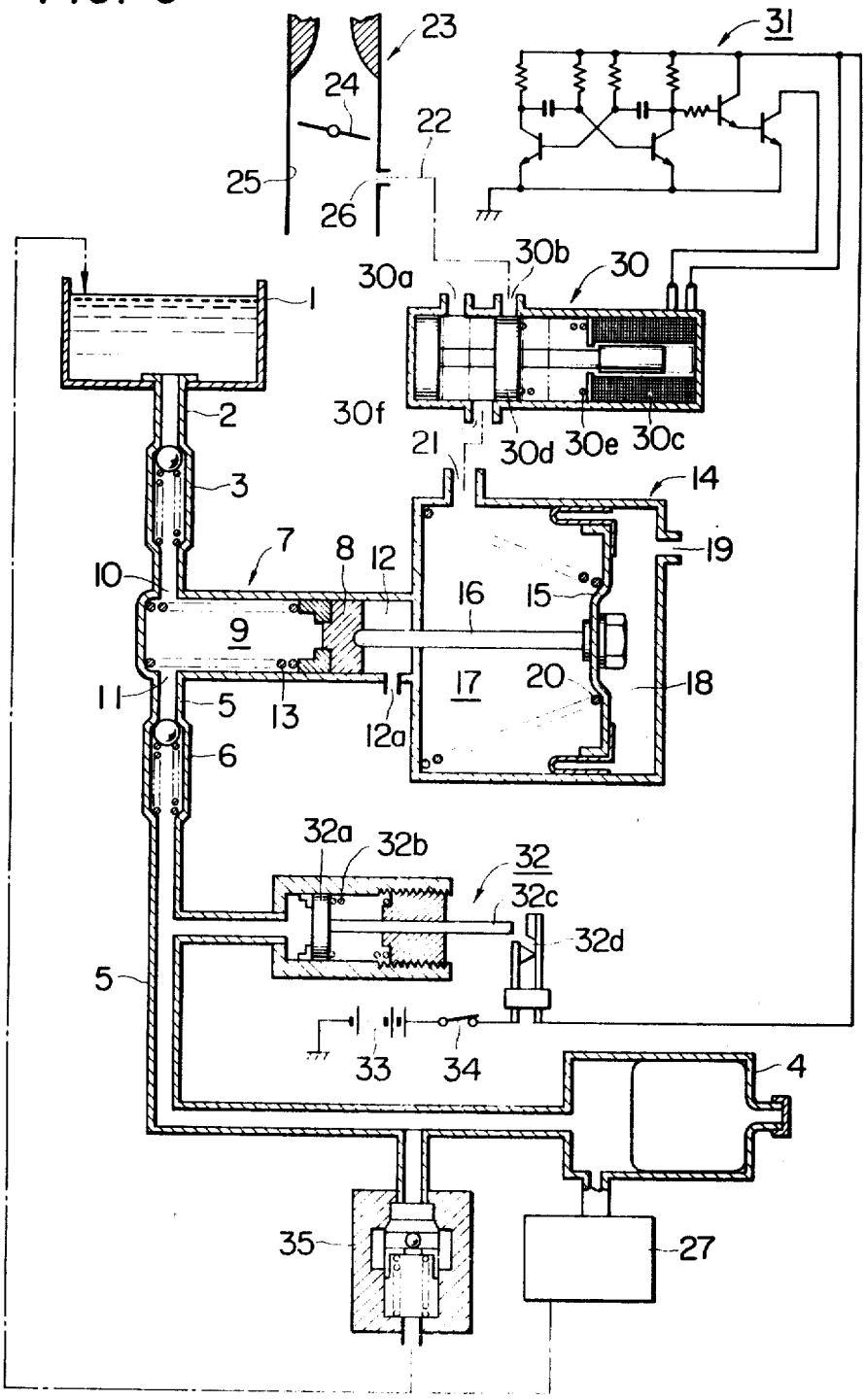
FIG. 3 shows schematically a second preferred embodiment of the present invention but this time incorporating a control system characterized by an unstable multivibrator which controls the communication between the induction manifold of the engine and the vacuum motor of the pressurised fluid supply system.

FIG. 3 shows a second preferred embodiment of the present invention. It will be understood that the construction of the vacuum motor 14, the slave cylinder 7, the reservoir 1 and the accumulator are the same as in the first embodiment. However this embodiment has a control system consisting of a three way electromagnetic valve 30, an unstable multivibrator 31 and switch apparatus generally denoted by 32 responsive to the pressure stored in the accumulator to disconnect the unstable multivibrator from the source of electrical power or electromotive force when a desirable pressure has been developed in the accumulator 4. A fail safe pressure release valve 35 permits dumping of fluid from the accumulator to the reservoir 1 in case of dangerous or damaging pressure build up in the accumulator.

Let us now consider the control system in detail. As shown a three way electromagnetic valve generally denoted by the numeral 30 is connected between the ports 21 and 26 of the vacuum motor and the induction manifold respectively. As before the port 26 is located downstream of the throttle valve 24. A spool **30*d* is slidably disposed in a bore (no numeral) formed in the body of the three way electromagnetic valve. A solenoid coil 30*c* is disposed at one end of the aforementioned bore and arranged to attract the spool 30*d* against the biasing force of a spring 30*e* to a second operative position from the first operative position it takes when the coil 30*c* is not energized as shown in FIG. 3. As shown the spring 30*e* is disposed between a first land of the spool 30*d* and the end of the adjacent end of the solenoid coil 30*c*. A second land is formed on the spool and is located so that the first land is located between it and the aforementioned coil. Three ports 30*a*, 30*b* and 30*f* are formed in the body of the three way electromagnetic valve, the first 30*a* is arranged to communicate the atmosphere with a space defined between the first and second lands when the spool takes the first operative position. The second port 30*b* is arranged to communicate with the induction manifold via port 26 and conduit 22, (shown in broken line) and with the space defined between the first and second lands when the spool takes the aforementioned second operative position. The last port 30*f*** is arranged to constantly communicate with the space defined between the first and second lands irrespective of whether the spool is in the first or second operative positions. The arrangement of the foregoing being such that when the solenoid coil is energised the spool takes the second operative position and thus communicates the second and third ports so that vacuum prevailing in the induction manifold is transmitted through to the third port, and when in the de-energised state the solenoid coil permits the spool to take the first operative position and thus communicate the first and third ports so that atmospheric air is permitted to pass through to the third port.

Now the switch apparatus generally denoted by the numeral 32 is constructed of a housing which is fluidly communicated with the conduit 5 via a branch conduit (no numeral). Slidably disposed in a bore formed in the housing is a piston **32*a* which defines within said bore a chamber which receives pressurised fluid therein. A spring 32*b*** is disposed between a sealing member (which will be referred to as a plug in this disclosure) and the piston to bias the piston in a direction away from the plug (which is sealingly threaded into the open end of the bore) viz. in a direction against the biasing force of the pressurised fluid in said chamber defined in the aforementioned bore.

A rod **32*a* connected at one end of the piston is arranged to pass slidably through the sealing member or plug to be contactable with a normally closed switch 32*d* to open same on contact therewith. Electrically connected to one terminal of the switch 32*d* is a main switch 34. This main switch is in turn connected to a source of electromotive force; in this case a battery 33 the negative terminal of which is shown connected to ground and the positive terminal to the main switch 34. With this arrangement current is permitted to flow through the normally closed switch 32*d*** once the main switch is closed.

Interposed between the normally closed switch **32*d* and the 3 way electromagnetic valve 30 is an unstable multivibrator 31. As will be understood by one skilled in the art the circuitry of the unstable multivibrator 31 is arranged to act as an oscillator and produce a signal the frequency or period of which is determined by appropriately selecting the resistors and capacitors constituting same. This signal is applied to the solenoid coil 30*c*** to periodically energise same to periodically move the spool between the aforementioned first and second operative positions.

In operation the vacuum prevailing in the induction manifold is transmitted through the conduit 22 to the three way electromagnetic valve 30 whereupon opening thereof in response to the signal fed to the solenoid coil **30*c* from the unstable multivibrator 31 permits vacuum to prevail in the vacuum chamber 17 of the vacuum motor 14. The piston 15 is thus urged by the pressure differential across same to in turn urge the slave cylinder piston 8 leftwardly as seen in FIG. 3 to displace the working fluid in the chamber 9. A predetermined time after the solenoid coil 30*c* is energised by a first signal from the unstable multivibrator 31 the signal disappears or in other words is replaced by a second signal. The three way electromagnetic valve 30 then disconnects the vacuum chamber with the source of vacuum and connects it with the atmosphere. The piston 15 is thus returned to its home or rest position under the influence of the springs 13 and 20, the pressure differential across the piston 15 having disappeared. A predetermined time later the solenoid coil 30*c* receives the first signal from the unstable multivibrator to once again connect the vacuum chamber 17 with the induction manifold and isolate said chamber from the atmosphere. It will be noted that the time intervals between switching from one signal to the other is so selected as to be very closely related to the time necessary for one working stroke of the piston 15 of the vacuum motor 14** for reasons which will be understood by one skilled in the art.

Upon a predetermined volume of pressurised working fluid being pumped via the above described operation into the accumulator 4 the biasing force of the spring **32*b* disposed between the piston 32*a* and the plug member is overcome by the pressure acting on the working face of the piston (i.e. the face which is in contact with the pressurised fluid) and the piston is urged in a direction which causes the rod member 32 to contact with and open the normally closed switch 32***d*.

On opening of the switch 32*d* the connection between the source of electromotive force and the unstable multivibrator 31 is cut and the functioning of said multivibrator stops. Due to its construction and arrangement the three way electromagnetic valve 30 permits the communication between the atmosphere and the vacuum chamber 17 upon disconnection of the multivibrator and the battery 33 (source of electromotive force).

As the stored pressurized fluid is depleted via the operation of the apparatus 27 fluidly connected to the accumulator the piston 32*a* is permitted to return to a position where the switch 32*d* closes and the operation of the unstable multivibrator recommences, electrical power being fed thereto once again. At this time the above described connection and disconnection of the vacuum chamber alternately with the induction manifold and the atmosphere continues whereby pumping of the working fluid in the reservoir 1 into the accumulator 4 is achieved.

Now for any reason should the switch 32*d* fail to open when the aforementioned predetermined pressure prevails in the accumulator 4 the excessive pressure in conduit 5 which would cause rupturing or other damage to the system is dumped via a relief valve 35 into the return conduit interconnecting the apparatus 27 and the reservoir 1 for return of the excess working fluid to the reservoir. Thus the system according to the second embodiment of the present invention is fail safe in two ways; one via the switch apparatus 32 and the other via the relief valve 35.

It has been revealed by a series of experiments that an optimally operating system can be assembled if (in all embodiments) 4 to 8 strokes of the slave cylinder piston 8 fills the accumulator which has a capacity of approximately 100 cc with fluid under 10 to 25 Kg./sq.cm. and the apparatus operatively connected to the accumulator (i.e. apparatus 27) is operable using about 50 cc of said fluid.

The second preferred embodiment however has one short coming and that is it is difficult to unfailingly synchronise the operation of the three way electromagnetic valve 30 with the piston 15 due to the variations in the vacuum prevailing in the induction manifold (previously described) whereby a constant rate of reciprocation of the piston 15 is not maintained. Hence it sometimes occurs that the piston has not completed a full working stroke (in either direction) when the connection between the atmosphere and the induction manifold is changed untimely by the three way electromagnetic valve 30. Erratic operation naturally results.

Figure 4:
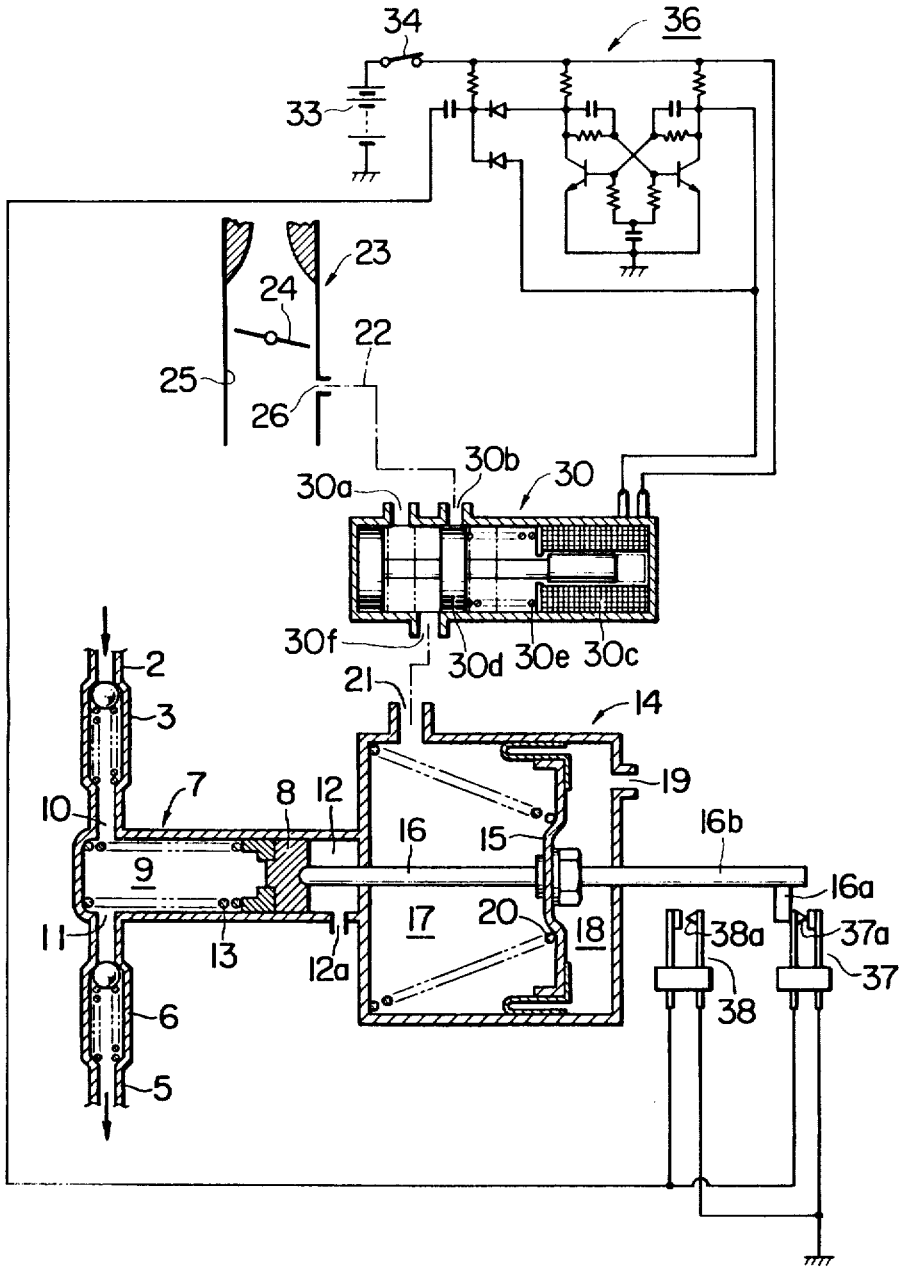
FIG. 4 shows a portion of a third embodiment of a pressurised fluid supply system having a control system which is characterized by a dual stable multivibrator which is triggered by the working strokes of the vacuum motor.

The third preferred embodiment is directed to solving this problem and is shown in FIG. 4.

As seen in FIG. 4 the construction of the three way electromagnetic valve 30 is unchanged as is the construction of the slave cylinder. For simplicity only a part of the system is shown in this figure however it is to be understood that the reservoir 1, pressure accumulator 4, pressure relief valve 35 and apparatus 27 are connected to the two conduits 2 and 5 as shown in FIG. 3. If desired the switch apparatus 32 can be included although not shown operatively connected in this embodiment. The construction of the vacuum motor 14 is slightly modified to provide a rod 16*b* fixedly connected to the piston 15 for movement therewith having a projection 16*b* which extends through a hole formed in the casing of the motor. As seen the rod is connected to the piston on the atmospheric side at a first end thereof and arranged to have a projection 16*a* formed on the end thereof. Arranged to be contacted by the projection 16*a* when the piston reaches or approaches the two extreme limits of its travel (i.e. its home position and the position it assumes at the end of a full working stroke toward the slave cylinder 7) are two normally open switches 37 and 38. The first switch 37 is arranged to be contacted and closed by the projection 16*a* when the piston 15 assumes its home position and the second switch 38 contacted and closed by the projection 16*a* when the piston reaches the limit of its working stroke (toward the slave cylinder). Hence when the piston moves from its home position toward the slave cylinder 7 the switch 37 which has been held closed by the projection 16*a* is permitted to open. Thus while the piston 15 is moving between the two aforementioned positions both switches are permitted to assume open positions. Each of the switches has a first and a second terminal. The first terminal of each switch is connected to earth or ground and each second terminal is connected to a capacitor which is included in the circuitry of a dual stable multivibrator denoted by the numeral 36. A battery or source of electromotive force 33 is connected through a main switch 34 to both the dual stable multivibrator and the solenoid coil 30*c* of the three way electromagnetic valve 30, and to earth. The solenoid coil 30*c* is also connected through the dual stable multivibrator 36 to earth. The arrangement of the circuitry being such that when either of the movable contacts 37*a* or 38*a* of the switches 37 and 38 are abutted by the projection 16*a* and contacted with the juxtaposed stationary contacts (the contact between the movable contact and the stationary contact lasting for a short time only during normal operation) the capacitor interposed between the switches and the dual stable multivibrator is momentarily grounded and the multivibrator changed from one state to another. As will be apparent to one skilled in the art the dual stable multivibrator is arranged to permit the flow of current to the solenoid coil 30*c* in a first state and cut the flow of current thereto when in the second state, whereby the spool of the three way electromagnetic valve is moved from the first operative position when said multivibrator takes the first state and to the second operative position and returned when said vibrator takes the second state.

Thus in operation when the control system comprising the switches 37 and 38 and the dual stable multivibrator 36 are energised by closing the main switch 34 the multivibrator immediately enters the first state and energises the solenoid coil 30*c*. This unfailingly occurs because the capacitor connected to the switches is always discharged during non operation of the pressurised fluid supply system, the piston assuming its home position when the pressure differential there across is negligible. In this position the switch 37 is constantly closed by projection 16*a* to ensure the earthing or grounding of the capacitor.

Upon energisation of the solenoid coil the spool 30*d* is moved to the second operative position whereupon the vacuum prevailing in the induction manifold is transmitted to the vacuum chamber of vacuum motor 14. The piston 15 is moved via the pressure differential thereacross toward the slave cylinder 7 urging the piston 8 in a similar direction to displace the working fluid in the chamber 9 as previously described. After travelling only a short distance from the home position the projection 16*a* will move out of contact with the movable contact 37*a* of the switch 37. However the dual stable multivibrator will remain in the first state because no signal to change state is issued by this. Hence the solenoid coil 30*c* will remain energised. However as the piston 15 approaches the limit of its travel the second switch 38 is so located that the movable contact 38*a* is contacted by the projection 16*a* to once again temporarily ground the aforementioned capacitor. This grounding generates a signal which causes the dual stable multivibrator to change state i.e. enter the second state where no current is permitted to pass through the solenoid coil. At this time the spool 30*d* returns to the first operative position to communicate the vacuum chamber 17 with the atmosphere. The piston immediately begins returning toward its home position as the vacuum in the vacuum chamber rapidly disappears. After having travelled only a short distance toward the home position the projection 16*a* moves out of contact with the movable contact 38*a* of the switch 38. The grounding of the capacitor ceases but until the projection reaches the movable contact of the first switch 37*a* the capacitor remains in this condition and the dual stable multivibrator remains in the second state. Upon contact with the movable contact 37*a* the grounding of the capacitor once again occurs and the state of the dual stable multivibrator is once again changed to the first state wherein the solenoid coil 30*c* is energised and the above described operation is repeated.

Hence it will be clear that the secoond embodiment is controlled in accordance with the reciprocations of the piston 15, the electronic control system being set and reset by trigger signals issued by a capacitor which is temporarily grounded at the beginning and end of each working stroke of the piston. It will be noted that throughout this document "working stroke" is construed to mean a stroke of the piston in a single direction i.e. from its home position to the other extreme position is a working stroke and stroke from said extreme position to the home position is another separate working stroke.

Thus if the degree of vacuum prevailing in the induction manifold is quite low due to a change of engine operating mode and the movement of the piston is somewhat slower than normal because of this, no problem will arise because the triggering of the multivibrator is directly related to the working strokes of the piston.

Figure 5:
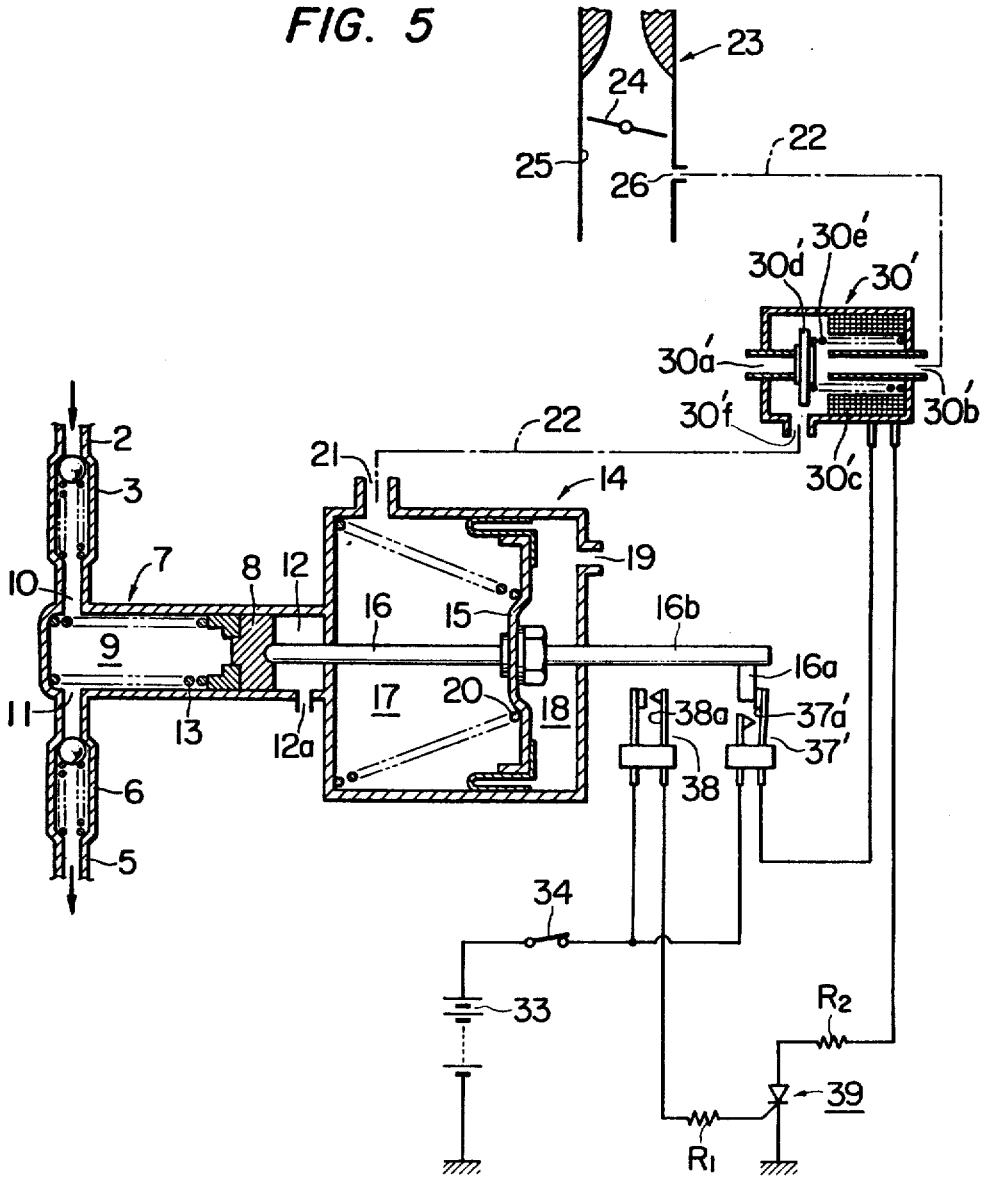
FIG. 5 shows a portion of a fourth preferred embodiment of the pressurized fluid supply system having a control system which is characterized by the provision of a thyristor is an electrical circuit thereof.

In FIG. 5 yet another preferred embodiment of the invention is shown. In this case the control system is somewhat different than from the preceeding one in that the dual stable multivibrator is replaced by a circuit containing a thyristor 39. The construction of the vacuum motor 4 is identical with that of FIG. 4 and has a rod 16*b* similarly arranged with a projection 16*a* which contacts upon stroking of the piston 15 two switches 37′ and 38. The switch 37′ is different in this case being a normally closed switch equipped with a movable contact 37′*a*. The switch 38 has the same construction as before, i.e. is normally open end has a movable contact 38*a*. The arrangement of the foregoing being such that the piston 15 on reaching or approaching the home position opens the switch 37′ via contact of the projection 16*a* with the movable contact 37′*a* and on reaching or approaching the other extreme position the switch 38 is closed via the contact of the projection 16*a* with the movable contact 38*a*.

A battery 33 or source of electromotive force is connected in parallel to the stationary contacts of the switches 38 and 37′ and a main switch 34 interposed in series therebetween as shown. The movable contact 38*a* of the switch 38 is connected to the gate of the thyristor 39 through a first resistor $R_1$. As shown the anode of the thyristor is connected to earth and the cathode thereof connected through a second resistor $R_2$ to a first terminal of a solenoid coil 30′*c* of a three way electromagnetic valve 30′. This valve will be described in detail later. The other or second terminal of the solenoid coil 30′*c* is connected as shown to the movable contact of the normally closed switch 37′.

The aforementioned three way electromagnetic valve 30′ is somewhat different from those of the preceeding two embodiments. In this case the conduit 22 interconnects the port 26 with a port 30′*b* which is arranged as shown to pass through the center of the aforementioned solenoid coil 30′*c*. The port 30′*a* communicating with the atmosphere is arranged to be axially aligned with that communicating with the induction manifold i.e. 30*b*′. A flat valve member 30′*d* is arranged to be biased by a spring 30′*e* to close the atmospheric port 30′*a* when the coil is deenergised and be attracted to close the port communicating with the induction manifold when the aforementioned solenoid coil is energised. A port 30′*f* is arranged as shown to be communicated with one or the other of the two ports 30′*a* and 30′*b* so as to be either communicated with the atmosphere of the induction manifold in accordance with the energisation or deenergisation of the coil 30′*c*.

In operation when the main switch is closed and electrical power is fed to the electronic control system nothing will happen until the vacuum in the induction manifold reaches a level whereupon the piston 15 will be urged as previously described by the pressure differential created thereacross. It will be noted that the three way electromagnetic valve 30′ is arranged to communicate the induction manifold and the vacuum chamber of the vacuum motor when deenergised as compared with the spool types previously described in connection with the second and third embodiments. Thus after the piston has travelled a short distance from its home position the normally closed switch 37′ will be permitted to close and permit the electrical connection between the battery 33 and the second terminal of the solenoid coil. However no current is permitted to flow through the coil at this time because the thyristor 39 is still in a non conductive state. Thus vacuum is continuously fed into the vacuum chamber 17 until the projection 16*a* contacts and closes the normally open switch 38*a*. At this time a small current is permitted to reach the gate of the thyristor 39 through the first resistor $R_1$. This renders the thyristor conductive and instantly current is permitted to flow through the solenoid coil 30′*c*. Thus the flat valve member 30′*d* is attracted to open the atmospheric port and close the port communicated with the induction manifold. The vacuum prevailing in the vacuum chamber is quickly bled off and the piston 15 moves toward its home position. This permits the switch to once again assume its normally open state, however current continues to flow through the coil 30*c* because the thyristor continues to remain in a conductive state despite the disappearance of the current fed to the gate. On contact of the projection 16*a* with the movable contact 37′*a* of the normally closed switch 37′ connection between the battery 33 and the solenoid coil 30′*c* is cut whereby the thyristor 39 is rendered non conductive and the coil is deenergised permitting the flat valve member to be biased by the spring 30′*e* to close the atmospheric port 30'a and open the port 30'b communicated with the induction manifold. Once again vacuum is fed into the vacuum chamber 17 and the afore described procedure is repeated.

Once again in this embodiment it is possible to incorporate the pressure relief valve 35 and the valve apparatus 32 described in conjunction with FIG. 3. Such additions will in fact be rather obvious to one skilled in the art.

Figure 6:
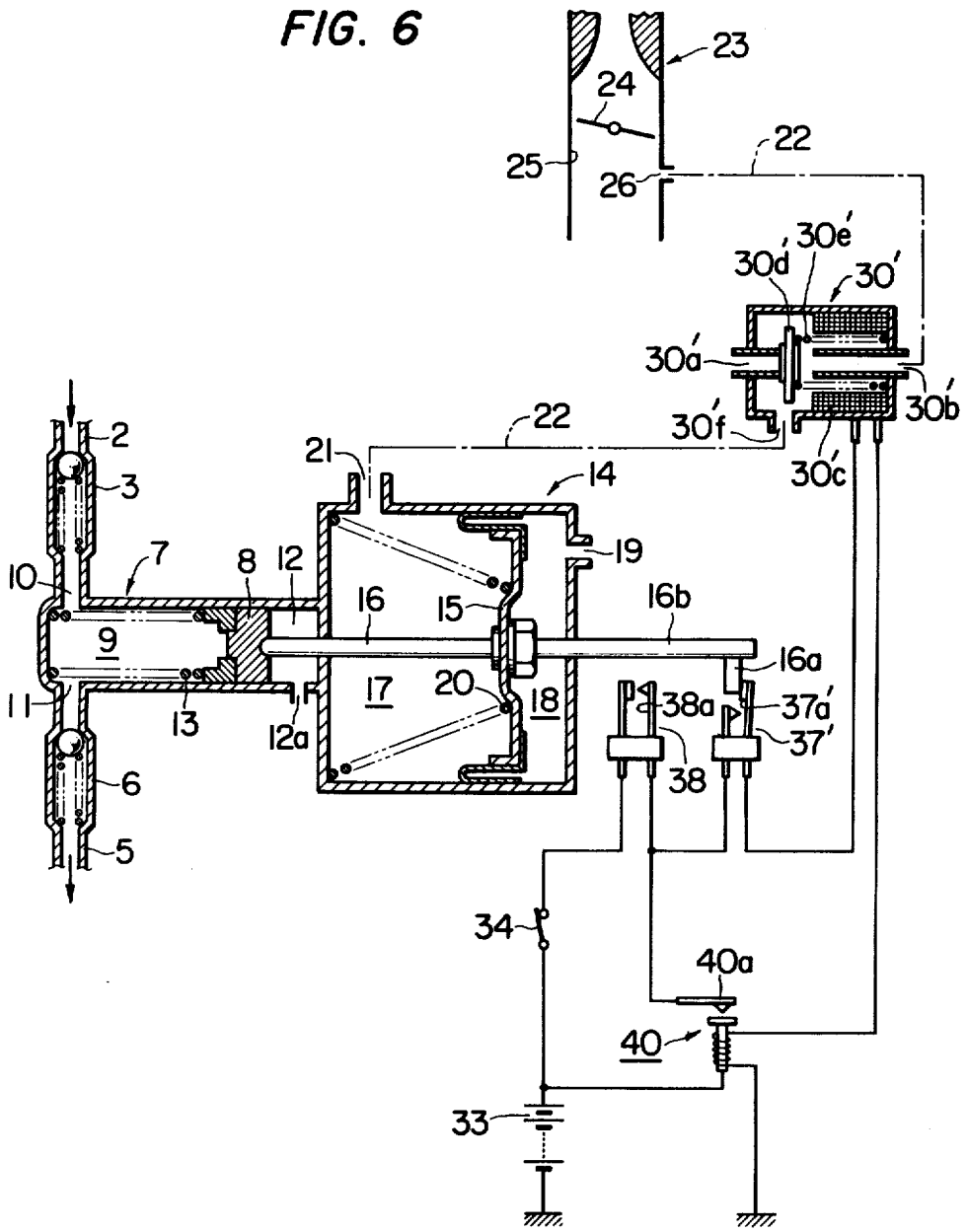
FIG. 6 shows a portion of a fifth preferred embodiment of the pressurised fluid supply system having a control circuit which is characterized by a self maintaining relay in the electrical circuit thereof.

Let us now turn to FIG. 6 wherein there is shown a fifth embodiment of the pressurised fluid supply system according to the present invention. In this embodiment an identical arrangement of the slave cylinder 7, vacuum motor 14, switches 37' and 38, rod and projections 16b and 16a and three way solenoid valve 30' is employed. Thus for brevity a description of the construction and operation will be epitomized with that for the electrical circuit which distinguishes it from the previous embodiment.

A battery 33 is connected through a main switch 34 to the normally open switch 38 as shown. In this case the normally closed switch 37' is connected in series with the battery and the normally open switch 38 as compared with the parallel arrangement of the previous embodiment. The movable contact 38a of the switch 38 is connected in parallel with the stationary contact of the normally closed switch 37' and a movable contact 40a of a self maintaining relay 40, as it will be referred to hereinafter. The movable contact 37'a of the normally closed switch 37' is as before connected to one terminal of the solenoid coil 30'c. The other terminal of the coil being connected to another solenoid coil (no numeral) wound around but insulated from a soft iron core which forms part of the self maintaining relay 40. As shown the soft iron core is connected to the positive terminal of the battery as is the main switch 34 and the other terminal of the coil wound around the soft iron core is connected to ground.

Thus in operation when the main switch 34 is closed to energise the electrical circuit the arrangement is such the three way electromagnetic valve 30' remains as before the energising of the circuit to connect the vacuum chamber 17 with the induction manifold. The piston is thus moved from its home position under the influence of the pressure differential created thereacross. The normally closed switch 37' is permitted to close after the piston has moved a short distance from the aforementioned home position. The solenoid coil 30'c remains in a deenergised state to permit the piston to continue its travel toward the other extreme position. As before on approaching or reaching the other extreme position the normally open switch 38 is closed via contact of the projection 16a with the movable contact 38a. By this closing of the switch 38 a current is permitted to flow from the battery 33 through the now closed switch 38, the switch 37' connected in series thereto, through the solenoid coil 30'c, and through the coil wound about the soft iron core to earth. However as the current passes through the coil wound about the soft iron core, the core is magnetised and attracts the movable contact 40a into contact therewith. This of course permits the flow of current from the battery 33 through the core itself, through the normally closed switch 37' which is now closed because the piston is still in a position where the projection is near or contacting the movable contact 38a of the switch 38; and to and through both solenoid coils to ground. Of course from the moment the movable contact 38a is urged into contact with the stationary contact of the switch 38 energizing the solenoid coil 30'c the flat valve member 30d will begin to move under magnetic attraction toward the port 30'b which communicates with the induction manifold to close same and open the atmospheric port 30'a. This quickly leads to the situation where the vacuum prevailing in the vacuum chamber is bled off permitting the piston 15 to return toward its home position. During this stroke of the piston the coil wound around the soft iron core will remain energized because that energization maintains the contact between the movable contact 40a and the core which in turn provides the current for the afore mentioned energization. However when the projection 16a contacts the movable contact 37'a of the switch 37' the flow of current from the battery through the soft iron core to the solenoid 30'c is interrupted or cut whereupon energization of both coils will cease. Thus the movable contact 40a will move out of contact with the soft iron core and the flat valve member 30'd will move to open the port 30'b and close 30'a. At this time the afore described procedure will recommence, i.e. the vacuum fed into the vacuum chamber 17 will reestablish the pressure differential which will move the piston 15 away from its home position to subsequently reclose the normally open switch 38 to energize the coil wound around the soft iron core.

Hence repetitious pumping or displacement of working fluid from the reservoir 1 to the accumulator 4 via the slave cylinder 7 will continue as long as the main switch remains closed.

Figure 7A:
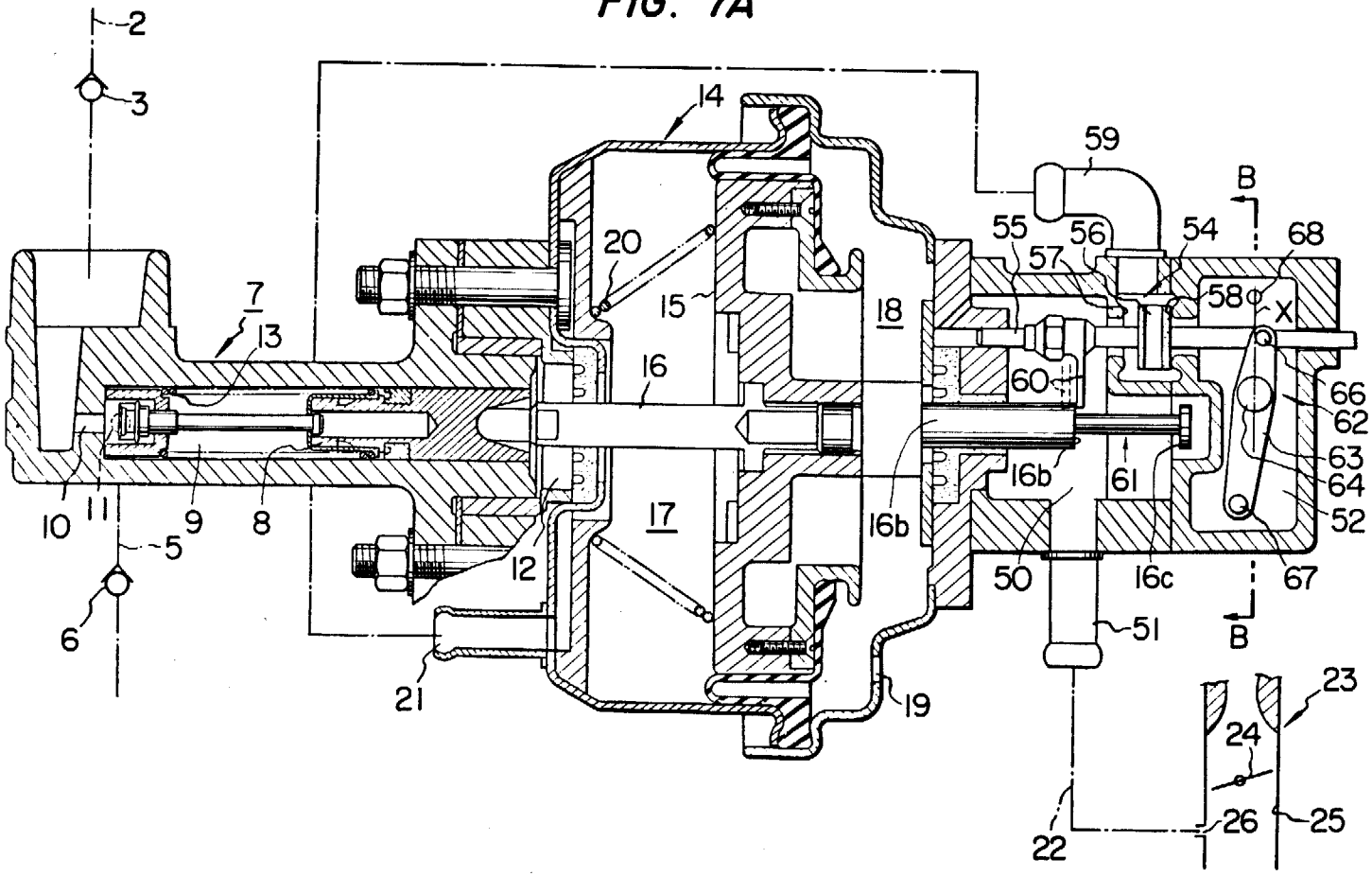
FIG. 7A shows in detailed section a portion of a sixth preferred embodiment of the pressurised fluid supply system which is characterized by a purely mechanical control device for controlling the communication between the induction manifold, the atmosphere and the vacuum motor of the above mentioned system.
Figure 7B:
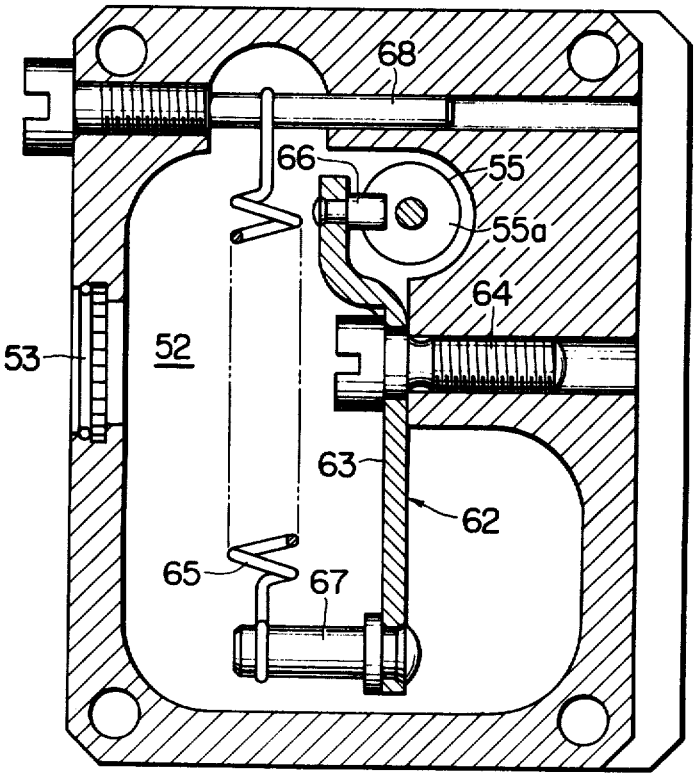
FIG. 7B is a sectional view of the mechanical control system shown in FIG. 7A taken along the section line B—B of the same fig.

The last preferred embodiment of the present invention is shown in FIGS. 7A and 7B. These are detailed sectional views of a pressurized fluid supply system which has a purely mechanical operating mechanism in contrast with the second, third, fourth and fifth embodiments which are equipped with electronic control systems and the first embodiment which is controlled only by the vacuum fluctuations in the induction manifold. In these figures numerals used in the previous figures will denote like parts although they are shown in detail as compared with the previous schematic representation.

In brief the mechanical control system consists of a lost motion device 61 which triggers a snapwise motion of a position maintaining device 62 which moves and maintains a two position valve 54 in and between first and second positions whereby communication between the vacuum chamber 17 of the vacuum motor 14 is switched between an atmospheric chamber 52 and a vaccum ante chamber 50.

In detail the mechanical control mechanism has a lost motion device denoted by the numeral 61 which is formed on or in the rod 16b which as previously described is fixed to the piston 15 for simultaneous movement therewith. The illustrated lost motion device consists of two steps or land like projections 16c and 16d. In this case the portion of the rod spanning the distance between the two projections as they will be referred to hereinafter is of a reduced diameter compared with the portion interconnecting the lost motion device with the piston proper. A shaft 55 is arranged to be slidably arranged within the housing enclosing the mechanical control system. As shown the shaft is parallel with respect to the rod 16b and extends throughout the longitudinal length of the housing. Fixed to the shaft 55 is an engaging lug 60 which is arranged to be contactable with the inboard surfaces of the two projections 16c and 16d. It will be noted that the lost motion device and the portion of the shaft 55 carrying the engaging lug 60 are arranged in a vacuum ante chamber 50 as it will be referred to hereafter. A port 51 is arranged to communicate the vacuum ante chamber with the induction manifold port 26 through a conduit 22. Now as seen in FIG. 7A the shaft 55 passes through two openings which define valve seats 57 and 58 respectively thereabout. Formed on the shaft is a piston 56 which is provided with sealing washers or surfaces on both sides thereof. These surfaces are arranged to be sealingly abutable with the afore mentioned valve seats 57 and 58. The opening defining the valve seat 58 is shown communicating with an atmospheric chamber 52. Disposed in this atmospheric chamber 52 is a snap action lever 63 which as best seen in FIG. 7B is connected by a tension spring 65 to a stationary rod 68. The snap action lever 63 is pivotably mounted on a pin 64 and has a pin 66 formed through one end thereof which engages a cut out portion 55*a* of the shaft 55 and at the other end thereof with another pin 67 which serves as a mounting member for the tension spring 65. Also shown in FIG. 7B is a through hole 53 which permits the chamber 52 to freely communicate with the atmosphere. The above construction will become more clearly understood as the description of the operation of same preceeds.

Let us consider the operation of this embodiment from the time just prior to starting the engine. At this time it will be understood that atmospheric pressure prevails in both the vacuum chamber 17 and the atmospheric chamber 18 of the vacuum motor and the piston 15, being in its home position causes the rod 16*b* to be urged into the housing of the mechanical control mechanism housing so that the engaging lug 60 is engaged with an inboard surface of the projection 16*d* which in turn urges the shaft 55 in a direction to cause the piston 56 of the two position valve 54 into sealing abutment with the valve seat 58. The reason for atmospheric pressure prevailing in both chambers 17 and 18 is that on stopping of the internal combustion engine to which the pressurized fluid supply ststem is connected, atmospheric pressure will prevail in the induction manifold thereof and via the construction of the vacuum motor the piston will naturally be urged to its home position.

However when the engine is started a vacuum will be created in the induction manifold which will be transmitted to the vacuum chamber via the port 51, the ante chamber 50, the port 59 and through the port 21. Thus the piston will be urged from its home position via the afore mentioned pressure differential. During this travel the engaging lug 60 is permitted to remain stationary since the projection 16*d* is moving away from the same. This situation continues until the projection 16*c* contacts the engaging lug 60 whereupon the lug and the connected shaft 55 are urged in the same direction as piston 15 for a predetermined distance. The afore mentioned distance being one which will initiate the operation of position maintaining device 62 to move the piston 56 into contact with the valve seat 57. The vacuum chamber 17 is thus disconnected from the vacuum ante chamber 50 by the closure of the opening defined by the valve seat 57 by the piston 56 and connected with the atmospheric chamber 52 via the opening of the opening defined by the valve seat 58 thereabout. Thus the vacuum prevailing in the vacuum chamber 17 will be quickly bled off via the communication with the atmospheric chamber to permit the piston 15 to begin returning to its home position. During this travel the engaging lug 60 will remain in its new position until engaged by the projection 16*d* whereupon it will be urged back through a distance equal in length to the aforementioned predetermined distance following which the operation of the position maintaining device 62 will be initiated once again. The piston 36 will be thus snapped to contact the valve seat 58. At this time connection between the induction manifold and the vacuum chamber 17 via the vacuum ante chamber 50 is established and the afore described operation recommences.

Hence in summary upon contact of the either of the inboard surfaces of the two projections 16*d* and 16*c* with the engaging lug 60 which is sufficient to urge the lug through a predetermined distance the piston maintaining device 62 operatively connected to the end of the shaft 55 which is located within the atmospheric chamber 52 reacts and "snaps" the shaft 55 to the new position. This position being of course one of the positions in which the piston 56 is engaged with either of the afore mentioned valve seats 57 and 58. The "predetermined distance" referred to above can be considered as a triggering distance after which the position maintaining device 62 completes the task of moving the piston 56 from one position to another.

Let us now consider the construction and operation of this position maintaining device in some detail. As best seen in FIG. 7A a line denoted by the letter X is drawn which coincides with the section line B—B. This line passes through the centre of the stationary rod 68 and the pin 64 which pivotably supports the snap action lever 63. It will be noted that when the piston 15 is in its home position and the piston 56 is accordingly sealingly abuted against the valve seat 58, the pin 66 is located on one side of the line X (as seen in FIG. 7A) and the pin 67 located on the other. The tension spring 65 is previously described is connected between the stationary rod 68 and the pin 67 so that in the illustrated position of the snap action lever 63 it is not parallel with the line X. During the transition of the snap action lever from the illustrated position to the position which places the pin 66 left of the line X and the pin 67 on the right thereof the spring in fact is momentarily parallel with the line X. However when parallel with the line X it is elongated compared with the illustrated position. Naturally the spring tends to urge the snap action lever toward a position which minimizes the tension therein i.e. a position which minimizes the length thereof and which maintains the shaft 55 in either the first or second positions.

By careful selection of the tension spring 65 smooth switching of the connection of the vacuum chamber 17 with the atmosphere or the induction manifold can be achieved, sufficient force being produced by the spring to hold the piston 56 sealingly in place but not prevent the movement thereof due to abutment of the projections and the engagement lug.

It will be noted that the lost motion device can undergo many variations without change of function. For example the rod 16*d* can be formed with a single slot or recess the inboard ends thereof abutting the engaging lug 60 to induce the shaft 55 to undergo the afore described movement through said predetermined distance which triggers the snap action of the snap action lever.

What is claimed is:

1. A pressurized fluid supply system for a motor vehicle equipped with an internal combustion engine, said internal combustion engine having an induction manifold and a throttle valve operatively disposed thereon, comprising:

reservoir means containing unpressurized working fluid;

reciprocating pump means fluidly communicating with said reservoir means for receiving working fluid therefrom;

vacuum motor means operatively connected to said reciprocating pump means for inducing the reciprocating motion of first piston means reciprocatingly disposed in said reciprocating pump means, said vacuum motor means having second piston means reciprocatingly disposed therein so as to divide said vacuum motor sealingly into a vacuum chamber and an atmospheric chamber, said vacuum chamber being fluidly connected to the induction manifold of said engine downstream of said throttle valve; and accumulator means fluidly connected to said reciprocating pump means for receiving pressurized fluid displaced therefrom thereinto;

control means interposed between said induction manifold and said vacuum motor for controlling the fluid communication therebetween, and pressure relief means fluidly connected between said reciprocating pump means and said accumulator means; said control means comprising:

an unstable multivibrator connected to a source of electromotive force through a main switch; and electromagnetic valve means interposed in a conduit interconnecting the induction manifold downstream of said throttle valve and said vacuum chamber, said electromagnetic valve means being arranged to communicate the vacuum chamber with the atmosphere when in a first state of energization and communicate the vacuum chamber with the induction manifold when in a second state of energization;

said unstable multivibrator being arranged to periodically take alternate first and second states, and said first state being one which induces said first state of energization in said electromagnetic valve means and said second state being one which induces said second state of energization in said electromagnetic valve means.

2. A pressurized fluid supply system for a motor vehicle provided with an internal combustion engine, said internal combustion engine having an induction manifold and a throttle valve operatively disposed thereon, comprising:

reservoir means containing unpressurized working fluid;

reciprocating pump means fluidly communicating with said reservoir means for receiving working fluid therefrom;

vacuum motor means operatively connected to said reciprocating pump means for inducing the reciprocating motion of first piston means reciprocatingly disposed in said reciprocating pump means, said vacuum motor means having second piston means reciprocatingly disposed therein so as to divide said vacuum motor sealingly into a vacuum chamber and an atmospheric chamber, said vacuum chamber being fluidly connected to the induction manifold of said engine downstream of said throttle valve; and accumulator means fluidly connected to said reciprocating pump means for receiving pressurized fluid displaced therefrom thereinto;

control means interposed between said induction manifold and said vacuum motor for controlling the fluid communication therebetween, and pressure relief means fluidly connected between said reciprocating pump means and said accumulator means;

said control means comprising:

a dual stable multivibrator connected to a source of electromotive force through a main switch;

electromagnetic valve means electrically connected to said dual stable multivibrator and interposed in a conduit interconnecting the induction manifold downstream of said throttle valve and said vacuum chamber and arranged to communicate said vacuum chamber with the atmosphere when in a first state of energization and communicate said induction manifold with said the vacuum chamber when in a second state of energization; and switch means electrically connected to said dual stable multivibrator, and constructed and arranged responsive to working strokes of said second piston means and to generate a trigger signal within said dual stable multivibrator each time said piston means approaches a limit of its reciprocatory travel to change said dual stable multivibrator between first and second stages, and said first state inducing said first stage of energization in said electromagnetic valve means and said second state inducing said second state of energization in said electromagnetic valve means.

3. A pressurized fluid supply system for a motor vehicle equipped with an internal combustion engine, said internal combustion engine having an induction manifold and a throttle valve operatively disposed thereon, comprising:

reservoir means containing unpressurized working fluid;

reciprocating pump means fluidly communicating with said reservoir means for receiving working fluid therefrom;

vacuum motor means operatively connected to said reciprocating pump means for inducing the reciprocating motion of first piston means reciprocatingly disposed in said reciprocating pump means, said vacuum motor means having second piston means reciprocatingly disposed therein so as to divide said vacuum motor sealingly into a vacuum chamber and an atmospheric chamber, said vacuum chamber being fluidly connected to the induction manifold of said engine downstream of said throttle valve; and accumulator means fluidly connected to said reciprocating pump means for receiving pressurized fluid displaced therefrom thereinto;

control means interposed between said induction manifold and said vacuum motor for controlling the fluid communication therebetween, and pressure relief means fluidly connected between said reciprocating pump means and said accumulator means; said control means comprising:

electromagnetic valve means interposed in a conduit fluidly interconnecting said vacuum chamber and said induction manifold constructed and arranged to communicate said vacuum chamber and said induction manifold when in a first state of energization and communicate said vacuum chamber and the atmosphere when in a second state of energization;

switch means electrically connected to said electromagnetic valve means and to a source of electromagnetic force through a main switch and constructed and arranged responsive to working strokes of said second piston means to produce a gate signal on said second piston means closely approaching a first limit of its reciprocatory travel and a second signal on closely approaching the second limit of its travel; and a thyristor electrically connected to said switch means and said electromagnetic valve means, the arrangement being such that said thyristor is arranged to be rendered conductive upon receiving said gate signal at its gate to cause the electromagnetic valve means to enter said second state of energization and to be rendered non conductive on receiving said second signal at its anode to cause said electromagnetic valve means to enter said first state of energization.

4. A pressurized fluid supply system for a motor vehicle provided with an internal combustion engine, said internal combustion engine having an induction manifold and a throttle valve operatively disposed thereon, comprising:

reservoir means containing unpressurized working fluid;

reciprocating pump means fluidly communicating with said reservoir means for receiving working fluid therefrom;

vacuum motor means operatively connected to said reciprocating pump means for inducing the reciprocating motion of first piston means reciprocatingly disposed in said reciprocating pump means, said vacuum motor means having second piston means reciprocatingly disposed therein so as to divide said vacuum motor sealingly into a vacuum chamber and an atmospheric chamber, said vacuum chamber being fluidly connected to the induction manifold of said engine downstream of said throttle valve; and accumulator means fluidly connected to said reciprocating pump means for receiving pressurized fluid displaced therefrom thereinto;

control means interposed between said induction manifold and said vacuum motor for controlling the fluid communication therebetween, and pressure relief means fluidly connected between said reciprocating pump means and said accumulator means; comprising:

electromagnetic valve means interposed in a conduit fluidly interconnecting said induction manifold and said vacuum chamber which is so constructed and arranged as to communicate said vacuum chamber and said induction manifold when in a first state of energization and communicate said vacuum chamber and the atmosphere when in a second state of energization;

switch means electrically connected to said electromagnetic valve means and to a source of electromagnetic force through a main switch and so constructed and arranged as to be sensitive to the working strokes of said second piston means to produce a first signal on said second piston means closely approaching a first limit of its reciprocatory travel and a second signal on closely approaching its second limit of travel; and self maintaining relay means electrically connected to said electromagnetic valve means and said means, the arrangement being such that self maintaining relay means is energized to close itself on receiving said first signal thus causing said electromagnetic valve means to enter said second state of energization and to be opened on receiving said second signal thus causing said electromagnetic valve means to enter said first state of energization.

5. A pressurized fluid supply system for a motor vehicle provided with an internal combustion engine, said internal combustion engine having an induction manifold and a throttle valve operatively disposed thereon, comprising:

reservoir means containing unpressurized working fluid;

reciprocating pump means fluidly communicating with said reservoir means for receiving working fluid therefrom;

vacuum motor means operatively connected to said reciprocating pump means for inducing the reciprocating motion of first piston means reciprocatingly disposed in said reciprocating pump means, said vacuum motor means having second piston means reciprocatingly disposed therein so as to divide said vacuum motor sealingly into a vacuum chamber and an atmospheric chamber, said vacuum chamber being fluidly connected to the induction manifold of said engine downstream of said throttle valve; and accumulator means fluidly connected to said reciprocating pump means for receiving pressurized fluid displaced therefrom thereinto;

control means interposed between said induction manifold and said vacuum motor for controlling the fluid communication therebetween, and pressure relief means fluidly connected between said reciprocating pump means and said accumulator means; said control means comprising:

lost motion means operatively connected to said second piston means;

two position valve means arranged to permit communication between said vacuum chamber and said induction manifold when in a first position and permit communication between said vacuum chamber and the atmosphere when in the second position, and having an engaging lug operatively engageable with said lost motion means so as to be urgeable thereby to first and second positions; and position maintaining means operatively connected to said two position valve means and constructed and arranged to maintain said two position valve means in either of said first and second positions with a predetermined force.

6. A system as claimed in claim 1 wherein said reciprocating pump means comprises:

a slave cylinder connected at a first end thereof to said vacuum motor and having a piston reciprocatingly disposed therein, said slave cylinder having an inlet port and an exhaust port formed in a second end thereof, said piston being biased away from said second end by a spring disposed between said piston and said second end, said piston and said spring comprising said first piston means and one way valve means disposed in said inlet port and said exhaust port, said one way valve means permitting the flow of working fluid from said reservoir means to said accumulator means only.

7. A system as claimed in claim 6 wherein said second piston means comprises:

a piston sealingly connected to the vacuum motor housing through a flexible sealing member;

biasing means disposed in said vacuum chamber to bias said piston into said atmospheric chamber; and a rod fixedly connected at one end thereof to said piston and arranged to sealingly pass through the vacuum motor housing so as to be contactable with the piston reciprocatingly disposed in said slave cylinder.

8. A pressurized fluid supply system for a motor vehicle having an internal combustion engine, said internal combustion engine having an induction manifold and a throttle valve operatively disposed thereon, comprising:

reservoir means for containing an unpressurized working fluid;

reciprocating pump means fluidly communicating with said reservoir means for receiving the working fluid therefrom and having a first piston means reciprocable therein;

vacuum motor means operatively connected to said reciprocating pump means for inducing the reciprocating motion of said first piston means; said vacuum motor means having a second piston means reciprocable therein so as to divide said vacuum motor into a vacuum chamber and an atmospheric chamber;

accumulator means fluidly connected to said reciprocating pump means for receiving pressurized fluid displaced therefrom thereinto; and first control means for causing the vacuum in said vacuum chamber to vary to the degree that reciprocation of said second piston means is induced, said first control means comprising; said throttle valve; and a conduit fluidly interconnecting said vacuum chamber and said induction manifold and communicating with said induction manifold immediately downstream of said throttle valve, and said conduit and said throttle valve cooperating so that opening and closing of said throttle valve causes said variation of said vacuum in said vacuum chamber.

9. A system as claimed in claim 8 further comprising: second control means interposed in said conduit between said induction manifold and said vaccum motor for controlling the fluid communication therebetween, and pressure relief means fluidly connected between said reciprocating pump means and said accumulator means.

10. A system as claimed in claim 9 further comprising switch means responsive to the pressure prevailing in said accumulator means for stopping the operation of said control means when a predetermined pressure prevails within said accumulator.

11. A system as claimed in claim 9 wherein said second control means comprises: a main switch;

an unstable multivibrator connected to a source of electromotive force through said main switch; and electromagnetic valve means interposed in said conduit interconnecting the induction manifold downstream of said throttle valve and said vacuum chamber, said electromagnetic valve means being arranged to communicate the vacuum chamber with the atmosphere when in a first state of energization and communicate the vacuum chamber with the induction manifold when in a second state of energization;

said unstable multivibrator being arranged to periodically take alternate first and second states, said first state being one which induces said first state of energization in said electromagnetic valve means and said second state being one which induces said second state of energization in said electromagnetic valve means.

12. A system as claimed in claim 9 wherein said second control means comprises: a main switch;

a dual stable multivibrator connected to a source of electromotive force through said main switch;

electromagnetic valve means electrically connected to said dual stable multivibrator and interposed in a conduit interconnecting the induction manifold downstream of said throttle valve and said vacuum chamber and arranged to communicate said vacuum chamber with the atmosphere when in a first state of energization and communicate said induction manifold with said vacuum chamber when in a second state of energization; and switch means electrically connected to said dual stable multivibrator, and sensitive to working strokes of said second piston means and generating a trigger signal within said dual stable multi-vibrator each time said second piston means approaches a limit of its reciprocatory travel to change said dual stable multivibrator between first and second states, said first state inducing said first state of energization in said electromagnetic valve means and said second state inducing said second state of energization in said electromagnetic valve means.

13. A system as claimed in claim 9 wherein said second control means comprises:

electromagnetic valve means interposed in said conduit fluidly interconnecting said vacuum chamber and said induction manifold constructed and arranged as to communicate said vacuum chamber and said induction manifold when in a first state of energization and communicate said vacuum chamber and the atmosphere when in a second state of energization;

a main switch; switch means electrically connected to said electromagnetic valve means and to a source of electromagnetic force through said main switch constructed and arranged as to be responsive to working strokes of said second piston means to produce a gate signal on said second piston means closely approaching a first limit of its reciprocatory travel and a second signal on closely approaching the second limit of its travel; and a thyristor electrically connected to said switch means and said electromagnetic valve means, the arrangement being such that said thyristor is arranged to be rendered conductive upon receiving said gate signal at its gate to cause the electromagnetic valve means to enter said second state of energization and to be rendered non conductive on receiving said second signal at its anode to cause said electromagnetic valve means to enter said first state of energization.

14. A system as claimed in claim 9 wherein said second control means comprises:

electromagnetic valve means interposed in said conduit fluidly interconnecting said induction manifold and said vacuum chamber which is constructed and arranged as to communicate said vacuum chamber and said induction manifold when in a first state of energization and communicate said vacuum chamber and the atmosphere when in a second state of energization;

switch means electrically connected to said electromagnetic valve means and to a source of electromagnetic force through a main switch and constructed and arranged as to be responsive to the working strokes of said second piston means to produce a first signal on said second piston means closely approaching a first limit of its reciprocatory travel and a second signal on closely approaching its second limit of travel; and self maintaining relay means electrically connected to said electromagnetic valve means and said switch means, the arrangement being such that self maintaining relay means is energized to close on receiving said first signal thus causing said electromagnetic valve means to enter said second state of energization and to be opened on receiving said second signal thus causing said electromagnetic valve means to enter said first state of energization.

15. A system as claimed in claim 9, wherein said second control means comprises;

lost motion means operatively connected to said second piston means;

two position valve means arranged to permit communication between said vacuum chamber and said induction manifold when in a first position and permit communication between said vacuum chamber and the atmosphere when in the second position, and having an engaging lug operatively engageable with said lost motion means so as to be urgeable thereby to first and second positions; and position maintaining means operatively connected to said two position valve means and constructed and arranged to maintain said two position valve means in either of said first and second positions with a predetermined force.

16. A system as claimed in claim 8 wherein said reciprocating pump means comprises:

a slave cylinder connected at a first end thereof to said vacuum motor and having a piston disposed reciprocable therein, said slave cylinder having an inlet port and an exhaust port formed in a second end thereof, a spring biasing said piston away from said second end and disposed between said piston and said second end, said piston and said spring comprising said first piston means and one way valve means disposed in said inlet port and said exhaust port, said one way valve means permitting the flow of working fluid from said reservoir means to said accumulator means only.

17. A system as claimed in claim 16 wherein said second piston means comprises:

a piston sealingly connected to the vacuum motor housing; a flexible sealing member sealingly connecting said piston to said motor housing;

biasing means disposed in said vacuum chamber to bias said piston into said atmospheric chamber; and a rod fixedly connected at one end thereof to said piston and arranged to sealingly pass through the vacuum motor housing so as to be contactible with the piston reciprocatingly disposed in said slave cylinder.

18. A system as claimed in claim 17 wherein said biasing means is constructed and arranged as to have a frustrated conical shape and be compressible without interfering with the travel of the piston of said second piston means through said vacuum chamber.

19. A system as claimed in claim 12 wherein said switch means comprises;

a pair of normally open switches;

a rod fixedly connected to said piston of said second piston means which is arranged to pass through said atmospheric chamber and project so that a projection formed on the end thereof is contactible with said pair of normally open switches, the first of said switches being located so as to be contacted by said projection when said piston closely approaches a first limit of its reciprocatory travel and the second of said switches being so located as to be contacted by said projection when said piston approaches the second limit of its reciprocatory travel, the stationary contact of said first switch and the movable contact of said first switch and the movable contact of said second switch being electrically connected to a capacitor operatively included in said dual stable multivibrator and the movable contact of said first switch and the stationary contact of said second switch being connected to earth, the arrangement of the above being such that said projection is movable between said first and second switches to contact the movable contacts thereof which are arranged inboard with respect to the stationary contacts.

20. A system as claimed in claim 13, wherein said switch means comprises:

a first normally open switch;

a second normally closed switch;

a rod fixedly connected to said piston of said second piston means which is arranged to pass through the atmospheric chamber and project from said vacuum motor so that a projection formed on the end thereof is contactible with said first and second switches, the first switch having a movable contact thereof urgeable into contact with a stationary contact thereof when said piston closely approaches a first limit of its reciprocatory travel and the second switch having a movable contact thereof urgeable out of contact with a stationary contact thereof when said piston closely approaches the second limit of its travel, said stationary contacts of said first and second switches being connected to said source of electromotive force through said main switch, said movable contact of said first switch being connected through a first resistor to the gate terminal of said thyristor, said movable contact of said second switch being connected to a second terminal of said electromagnetic valve means the first terminal of which is connected through a second resistor to the anode of said thyristor and the cathode of said thyristor is connected to earth.

21. A system as claimed in claim 14 wherein said switch means comprises:

a first normally open switch;

a second normally closed switch;

a rod fixedly connected to said piston of said second piston means arranged to pass through the atmospheric chamber and project from said vacuum motor and having a projection on the end thereof contactible with said first and second switches, the switch having a movable contact thereof urgeable into contact with a stationary contact thereof when said piston closely approaches its first limit of its reciprocatory travel and said second switch having a movable contact moved out of contact with a stationary contact thereof when said piston closely approaches the second limit of its reciprocatory travel, and wherein said self maintaining relay comprises:

a stationary contact having a soft iron core attached thereto;

a coil wound about but insulated from said soft iron core; and a movable contact attractable to contact said stationary contact upon energization of said coil; the arrangement of said switch means and said self maintaining relay being such that said stationary contact of said first switch is connected through said main switch to said source of electromotive force, the movable contact of said first switch is connected to the stationary contact of said second switch and said movable contact of said self maintaining relay, said movable contact of said second switch is connected to the second terminal of said electromagnetic valve means, the first terminal of which is connected to ground through said coil insulatingly disposed about a soft iron core attached to the stationary contact of said self maintaining relay, said soft iron core and said main switch being connected in parallel with said source of electromotive force.

22. A system as claimed in claim 11 wherein said electromagnetic valve means comprises a three way electromagnetic valve, said three way electromagnetic valve having a spool with two lands and reciprocatingly disposed in a bore formed in the body thereof, a solenoid coil to attract said spool from a first operative position to a second operative position when energized, a spring disposed between a land of the spool and the solenoid coil to bias the spool to said first operative position, said electromagnetic valve having first, second and third ports respectively communicated with the atmosphere, the induction manifold downstream of the throttle valve and the said vacuum chamber, the arrangements of the lands and the ports being such that in said first operative position the first port communicates with the third port via the space defined between said lands and in said second operative position the second port is communicated with the third port via the space between the lands.

23. A system as claimed in claim 22 wherein said first state of energization is one in which said solenoid coil of said electromagnetic valve is deenergized and said second state of energization is one in which said solenoid coil is energized.

24. A system as claimed in claim 12 wherein said electromagnetic valve means comprises: a three way electromagnetic valve, said three way electromagnetic valve having a spool formed with two lands and reciprocatingly disposed in a bore formed in the body thereof, a solenoid coil to attract said spool from a first operative position to a second operative position when energized, a spring disposed between a land of the spool and the solenoid coil to bias the spool to said first operative position, said electromagnetic valve having first, second and third ports, respectively communicated with the atmosphere, the induction manifold downstream of the throttle valve and the said vacuum chamber, the arrangements of the lands and the ports being such that in said first operative position the first port communicates with the third port via the space defined between said lands and in said second operative position the second port is communicated with the third port via the space between the lands.

25. A system as claimed in claim 24 wherein said first state of energization is one in which said solenoid coil of said electromagnetic valve means is deenergized and said second state of energization is one in which said solenoid coil is energized.

26. A system as claimed in claim 13 wherein said electromagnetic valve means comprises:

a three way electromagnetic valve having first, second and third ports formed in the body thereof, said ports communicating respectively with the atmosphere, said induction manifold downstream of the throttle valve and said vacuum chamber;

a solenoid coil disposed in said body so as to surround said second port; a spring;

a flat valve member biased toward said first port to close same by said spring which is disposed about said second port but within said solenoid coil, said flat valve member being attractible by said solenoid coil when energized to open said first port and close said second port;

the arrangement of the above being such that when the said coil is energized said first port is permitted to communicate with said third port and when said coil is deenergized said second port is permitted to communicate with said third port.

27. A system as claimed in claim 26 wherein said first state of energization is one in which said solenoid coil of said electromagnetic valve means is deenergized and said second state of energization is one in which said solenoid coil is energized.

28. A system as claimed in claim 14 wherein said electromagnetic valve means comprises:

a three way electromagnetic valve having first, second and third ports formed in the body thereof, said ports communicating respectively with the atmosphere, the induction manifold downstream of the throttle valve and said vacuum chamber;

a solenoid coil disposed in said body so as to surround said second port, a spring, a flat valve member which is biased toward said first port to close same by said spring which is disposed about said second port but within said solenoid coil, said flat valve member being attractible by said solenoid coil when energized to open said first port and close said second port, the arrangement of the above being such that when the said coil is energized said first port is permitted to communicate with said third port and when said coil is deenergized said second port is permitted to communicate with said third port.

29. A system as claimed in claim 28 wherein said first state of energization is one in which said solenoid coil of said electromagnetic valve means is deenergized and said second state of energization is one in which said solenoid coil is energized.

30. A system as claimed in claim 15 wherein said lost motion means comprises:

a rod fixedly attached to said piston of said second piston means and arranged to pass through said vacuum chamber and project from said vacuum motor and has first and second projections formed thereon;

wherein said two position valve comprises:

a shaft on which said engaging lug is formed and which has a cut out portion formed at one end thereof;

a piston coaxially mounted on said shaft arranged to be sealingly abutable with first and second ports formed in the housing in which said system is housed, said first port being in communication with said induction manifold via a vacuum ante chamber and a conduit fluidly connecting said vacuum ante chamber with said induction manifold downstream of said throttle valve and said second port communicating with an atmospheric chamber, said vacuum ante chamber and said atmospheric chamber being defined within said housing and wherein said position maintaining device comprises a snap action lever pivotably mounted within said atmospheric chamber and formed with an engaging pin on a first end thereof; a tension spring connected between the second end of said snap action lever and a stationary shaft disposed in said atmospheric chamber;

the arrangement of the foregoing being such that said engaging pin engages said cut out portion, said tension spring urges said snap action lever so as to in turn urge said shaft in either first or second directions, said first and second directions being such that said piston is urged into sealing abutment with either first or second ports where it is maintained with a predetermined force and said engaging lug is abutable with the inboard surfaces of said first and second projections so that said shaft is urged to move said piston from a position where it closes one of said ports to a position where it closes the other of said ports.

31. A pressurized fluid supply system for a motor vehicle equipped with an internal combustion engine, said internal combustion engine having an induction manifold and a throttle valve operatively disposed therewith, said system comprising:

reservoir means for storing unpressurizing working fluid therein;

pump means for pressurizing said working fluid, said pump means being fluidly communicated with said reservoir means for receiving said working fluid therefrom;

vacuum motor means for driving said pump means, said vacuum motor means having yieldable means interposed between a variable volume vacuum chamber and a variable volume atmospheric chamber, said vacuum chamber being fluidly communicated with said induction manifold at a location downstream of said throttle valve for receiving vacuum from said induction manifold;

accumulator means fluidly communicating with said pump means for storing pressurized working fluid discharged from said pump;

first control means for varying the vacuum fed from said induction manifold to said vacuum chamber in accordance with the opening and closing movements of said throttle valve; and second control means for alternatively permitting and obstructing said fluid communication between said induction manifold and said vacuum chamber.

32. A system as claimed in claim 2 wherein said reciprocating pump means comprises:

a slave cylinder connected at a first end thereof to said vacuum motor and having a piston reciprocatingly disposed therein, said slave cylinder having an inlet port and an exhaust port formed in a second end thereof, said piston being biased away from said second end by a spring disposed between said piston and said second end, said spring and said piston comprising said first piston means, and one way valve means disposed in said inlet port and said exhaust port, said one way valve means permitting the flow of working fluid from said reservoir means to said accumulator means only.

33. A system as claimed in claim 32 wherein said second piston means comprises:

a piston sealingly connected to the vacuum motor housing through a flexible sealing member;

biasing means disposed in said vacuum chamber to bias said piston into said atmospheric chamber; and a rod fixedly connected at one end thereof to said piston and arranged to sealingly pass through the vacuum motor housing so as to be contactible with the piston reciprocatingly disposed in said slave cylinder.

34. A system as claimed in claim 33 wherein said biasing means is so constructed and arranged as to have a frustrated conical shape and be compressible without interfering with the travel of the piston of said second piston means through said vacuum chamber.

35. A system as claimed in claim 3 wherein said reciprocating pump means comprises:

a slave cylinder connected at a first end thereof to said vacuum motor and having a piston reciprocatingly disposed therein, said slave cylinder having an inlet port and an exhaust port formed in a second end thereof, said piston being biased away from said second end by a spring disposed between said piston and said second end, said piston and said spring comprising said first piston means and one way valve means disposed in said inlet port and said exhaust port, said one way valve means permitting the flow of working fluid from said reservoir means to said accumulator means only.

36. A system as claimed in claim 35 wherein said second piston means comprises:

a piston sealingly connected to the vacuum motor housing through a flexible sealing member;

biasing means disposed in said vacuum chamber to bias said piston into said atmospheric chamber; and a rod fixedly connected at one end thereof to said piston and arranged to sealingly pass through the vacuum motor housing so as to be contactible with the piston reciprocatingly disposed in said slave cylinder.

37. A system as claimed in claim 36 wherein said biasing means is so constructed and arranged as to have a frustrated conical shape and be compressible without interfering with the travel of the piston of said second piston means through said vacuum chamber.

38. A system as claimed in claim 4 wherein said reciprocating pump means comprises:

a slave cylinder connected at a first end thereof to said vacuum motor and having a piston reciprocatingly disposed therein, said slave cylinder having an inlet port and an exhaust port formed in a second end thereof, said piston being biased away from said second end by a spring disposed between said piston and said second end, said piston and said spring comprising said first piston means and one way valve means disposed in said inlet port and said exhaust port, said one way valve means permitting the flow of working fluid from said reservoir means to said accumulator means only.

39. A system as claimed in claim 38 wherein said second piston means comprises:

a piston sealingly connected to the vacuum motor housing through a flexible sealing member;

biasing means disposed in said vacuum chamber to bias said piston into said atmospheric chamber; and a rod fixedly connected at one end thereof to said piston and arranged to sealingly pass through the vacuum motor housing so as to be contactible with the piston reciprocatingly disposed in said slave cylinder.

40. A system as claimed in claim 39 wherein said biasing means is so constructed and arranged as to have a frustrated conical shape and be compressible without interfering with the travel of the piston of said second piston means through said vacuum chamber.

41. A system as claimed in claim 5 wherein said reciprocating pump means comprises:

a slave cylinder connected at a first end thereof to said vacuum motor and having a piston reciprocatingly disposed therein, said slave cylinder having an inlet port and an exhaust port formed in a second end thereof, said piston being biased away from said second end by a spring disposed between said piston and said second end, said piston and said spring comprising said first piston means and one way valve means disposed in said inlet port and said exhaust port, said one way valve means means permitting the flow of working fluid from said reservoir means to said accumulator means only.

42. A system as claimed in claim 41 wherein said second piston means comprises:

a piston sealingly connected to the vacuum motor housing through a flexible sealing member;

biasing means disposed in said vacuum chamber to bias said piston into said atmospheric chamber; and a rod fixedly connected at one end thereof to said piston and arranged to sealingly pass through the vacuum motor housing so as to be contactible with the piston reciprocatingly disposed in said slave cylinder.

43. A system as claimed in claim 42 wherein said biasing means is so constructed and arranged as to have a frustrated conical shape and be compressible without interfering with the travel of the piston of said second piston means through said vacuum chamber.

* * * * *